US009987676B2

(12) United States Patent
Zumbusch et al.

(10) Patent No.: US 9,987,676 B2
(45) Date of Patent: Jun. 5, 2018

(54) FEEDER INSERT AND METHOD FOR ARRANGING SAME IN A CASTING MOLD

(71) Applicant: CHEMEX GMBH, Delligsen (DE)

(72) Inventors: Lars Zumbusch, Langenfeld (DE); Guido Brieger, Bochum (DE); Michael Biemel, Wuerzburg (DE)

(73) Assignee: CHEMEX GMBH, Delligsen (DE)

( * ) Notice: Subject to any disclaimer, the term of this patent is extended or adjusted under 35 U.S.C. 154(b) by 39 days.

(21) Appl. No.: 14/767,522

(22) PCT Filed: Jan. 10, 2014

(86) PCT No.: PCT/EP2014/050346
§ 371 (c)(1),
(2) Date: Aug. 12, 2015

(87) PCT Pub. No.: WO2014/124766
PCT Pub. Date: Aug. 21, 2014

(65) Prior Publication Data

US 2016/0030999 A1 Feb. 4, 2016

(30) Foreign Application Priority Data

Feb. 15, 2013 (DE) ..... 20 2013 001 418 U
Mar. 1, 2013 (DE) ..... 20 2013 001 932 U
Mar. 1, 2013 (DE) ..... 20 2013 001 933 U

(51) Int. Cl.
*B22C 9/08* (2006.01)
*B22C 21/14* (2006.01)
*B22C 23/00* (2006.01)

(52) U.S. Cl.
CPC ..... *B22C 9/088* (2013.01); *B22C 21/14* (2013.01); *B22C 23/00* (2013.01)

(58) Field of Classification Search
CPC ..... B22C 23/00; B22C 9/088
See application file for complete search history.

(56) References Cited

U.S. PATENT DOCUMENTS 5,299,625 A 4/1994 Miki
2004/0050526 A1 3/2004 Skerdi et al.
(Continued)

FOREIGN PATENT DOCUMENTS

DE 10039519 2/2002
DE 10059481 6/2002
DE 202004009367 8/2004
(Continued)

*Primary Examiner* — Kevin P Kerns
*Assistant Examiner* — Steven S Ha
(74) *Attorney, Agent, or Firm* — Duane Morris LLP; J. Rodman Steele, Jr.; Gregory M. Lefkowitz

(57) ABSTRACT

A feeder insert for use for the casting of metals into casting molds, having a mold body (6) and a supply element (4) which delimit the feeder cavity (10) for receiving liquid metal, wherein the supply element (4) has a passage opening (26) for the liquid metal, and wherein the mold body (6) is movable in a feeder longitudinal direction relative to at least one part of the supply element (4), characterized in that the supply element (4) has a deformation region which is designed to trim in at least in sections in at least a first phase of a relative movement of the mold body (6) in the feeder longitudinal direction and in the direction of the supply element (4).

20 Claims, 4 Drawing Sheets

(56) References Cited

U.S. PATENT DOCUMENTS

| | | | | |
|---|---|---|---|---|
| 2009/0014482 | A1 | 1/2009 | Tackaberry et al. | |
| 2012/0211192 | A1* | 8/2012 | Sallstrom | B22C 9/088 164/359 |

FOREIGN PATENT DOCUMENTS

| | | |
|---|---|---|
| DE | 202013102133 | 5/2013 |
| EP | 1184104 | 6/2002 |
| GB | 2260285 | 4/1993 |
| WO | 2005095020 | 10/2005 |

* cited by examiner

FEEDER INSERT AND METHOD FOR ARRANGING SAME IN A CASTING MOLD

This application is a § 371 national stage entry of International Application No. PCT/EP2014/050346, filed Jan. 10, 2014, which claims priority to German Patent Application No. 20 2013 001 418.0, filed Feb. 15, 2013, German Patent Application No. 20 2013 001 932.8, filed Mar. 1, 2013, and German Patent Application No. 20 2013 001 933.6, filed Mar. 1, 2013, the entire contents of which are incorporated herein by reference.

The present invention relates to a feeder insert for use for the casting of metals into casting molds, having a mold body and a supply element which delimit the feeder cavity for receiving liquid metal, wherein the supply element has a passage opening for the liquid metal, and wherein the mold body is movable in a feeder longitudinal direction relative to at least one part of the supply element. The invention also relates to a method for the arrangement of a feeder insert of said type in a casting mold.

Previously known feeder inserts, also referred to for simplicity as feeders, are used in particular during the production process of the casting of metals into casting molds. The feeder inserts conventionally form a space surrounded by a mold material of the casting mold. The space provided in the casting mold for receiving the liquid metal has a passage to the feeder cavity, into which a partial amount of the liquid metal poured into the casting mold then rises during the casting process. It is the intention for the liquid metal that has thus passed into the feeder to be able to flow back into the casting mold during the solidification process (which is associated with a contraction of the cast metal) and to serve there for compensation purposes or to make up for the volume losses.

To be able to ensure a return flow of the metal situated in the feeder, it must be ensured that the metal in the feeder lines remains in liquid form while the metal in the interior of the casting mold is already solidifying (to form the casting). For this purpose, at least a part of the feeder insert is composed of an insulating and/or exothermic material, wherein the exothermic material is ignited as a result of the introduction of liquid metal owing to the temperatures prevailing in the process. An exothermic reaction then self-evidently takes place within the feeder insert, by means of which exothermic reaction the metal situated in the feeder has heat energy supplied to it over a predetermined time period, and thus the metal in the feeder is kept in the liquid state.

DE 100 39 519 A1 has already disclosed a feeder insert for use for the casting of metals into casting molds, which feeder insert has a mold body and a supply element which delimit the feeder cavity for receiving liquid metal; said feeder has proven to be highly effective in practice. The supply element of the feeder has a passage opening for a connection from the feeder cavity of the mold body into the casting cavity, such that liquid metal can rise out of the casting cavity into the feeder cavity. The mold body is placed onto the supply element such that the mold body and the supply element are designed to be displaceable relative to one another in the feeder longitudinal direction or parallel to the feeder longitudinal axis. The telescopic displaceability of the mold body and of the supply element relative to one another has the effect that the pressure forces that act during the production of the casting mold and the associated compaction of the mold material, which pressure forces also act on the feeder, can be absorbed. Furthermore, as a result of the displaceability of the mold body in the direction of the supply element, it is possible to ensure a compaction of the mold material also in the extension region of the feeder at for example a pattern plate, because as a result of the displacement of the mold body in the direction of the pattern plate, the mold material is compacted around the supply element. To ensure the displaceability between the mold body and supply element, the known feeder insert has a gap between the parts that are movable relative to one another. Owing to the increasing or rising compaction pressures and the associated likewise increasing compaction of the mold material of the casting mold, which is associated with an increased displacement travel of the mold body along the supply element, it is possible in rare situations, in the case of incorrect handling, for parts of the mold material to pass through into the cavity of the feeder insert via the gap, and/or for abrasion of material of the insulating/exothermic feeder material to occur. The penetration of the mold material into the feeder cavity or the abrasion of feeder material is therefore, in the case of incorrect handling, associated with the risk of the mold material or the feeder material possibly passing into the casting cavity of the pattern plate, thus putting at risk the usability of the casting to be produced; in some cases, there is even the risk of fracture of the feeder insert.

DE 100 59 481 A1 has disclosed a feeder insert for a casting, having a feeder or feeder head and having a tubular body, wherein the tubular body connects the feeder or feeder head directly or indirectly to the casting or to the hollow mold body, and, toward the end facing toward the casting, narrows and forms a breaking edge.

GB 2 260 285 A discloses a riser sleeve with a breaking core, wherein the riser sleeve has a V-shape section and has an opening on its underside. The breaking core has a central opening and is arranged on the underside of the riser sleeve. The inner diameter of the central opening of the breaking core is substantially the same as the inner diameter of the opening in the base of the riser sleeve. The outer diameter of the breaking core is substantially equal to or greater than the outer diameter of the underside of the riser sleeve. The riser sleeve with breaking core reduces the reworking on the casting after the casting process.

US 2009/0014482 A1 discloses a feeder element for use in the casting of metal, wherein the feeder element has a first end for fastening to a mold pattern, an opposite, second end for receiving a mold body, and a bore between the first and second ends, which bore is formed by a stepped side wall. During use, the feeder element can be compressed, whereby the spacing between the first end and the second end is reduced, such that the stepped side wall has a first side wall region which forms the second end of the feeder element and which, during use, forms a mounting surface for the mold body. In this case, the first side wall section is inclined at an angle of less than 90° with respect to the axis of the bore. The stepped side wall has a second side wall region which adjoins the first side wall region and which runs parallel to the axis of the bore or obliquely with respect to the axis of the bore at a different angle than the first side wall region, whereby a shoulder is formed in the side wall.

WO 2005/095020 A2 discloses an insert for insertion into a casting mold which is used for the casting of metals and which has a casting cavity, which casting mold has a carcass which extends along a carcass longitudinal axis and which has a carcass cavity, wherein the carcass is formed from at least one first mold body, which has a connecting opening by which the carcass cavity can be connected to the casting cavity, and a second mold body, which is mounted on the supply element. In this case, the first mold body is in the form of an energy absorption device.

DE 20 2004 009 367 U1 discloses a feeder insert for insertion into a casting mold which is used for the casting of metals, said feeder insert being composed of a mold body which has a feeder volume and which is composed of an exothermic and/or insulating material, and to whose lower base surface, which faces toward the mold region for forming the casting, there is fastened a metal foot. In this case, the metal foot has a contour which projects from the base surface of the mold body to the mold surface, and has a feeder opening which is configured to form a predetermined breaking point for a feeder residue that forms in the feeder volume. The feeder insert can, during the production of the casting mold, be mounted by way of its metal foot onto a holding pin which is fastened to the pattern that forms the shape of the casting, wherein the metal foot has a shape which, overall, tapers conically from the base surface of the mold body to the mold surface, such that, in the finished casting mold, a lower end section, which forms the feeder opening, of the metal foot ends at the mold surface. The conical shell surface, surrounding the holding pin, of the metal foot has in this case a predetermined bending point.

Based on the problem specified above, it is therefore the object of the invention to specify a feeder insert which withstands high compaction pressures during the production of the casting mold and during the use of which the risk of penetration of mold material or feeder material into the casting cavity is also reduced.

In the case of a feeder insert of the type mentioned in the introduction, the invention achieves the object on which it is based in that the supply element has a deformation region which is designed to invert at least in sections in at least a first phase of a relative movement of the mold body in the feeder longitudinal direction and (simultaneously) in the direction of the supply element.

The invention thus relates to a feeder insert for use for the casting of metals into casting molds, having a mold body and a supply element which delimit the feeder cavity for receiving liquid metal, wherein the supply element has a passage opening for the liquid metal, and wherein the mold body is movable in a feeder longitudinal direction relative to at least one part of the supply element, wherein the supply element has a deformation region which is designed to invert at least in sections in at least a first phase of a relative movement of the mold body in the feeder longitudinal direction and in the direction of the supply element (that is to say during a relative movement in the direction of the supply element and simultaneously in the feeder longitudinal direction). Such a supply element thus inverts when a relative movement of the mold body in the feeder longitudinal direction and in the direction of the supply element is performed; here, within the context of the present invention, an inverting direction is not fixedly predefined, but the supply element is conventionally and preferably configured such that it inverts in the direction of the feeder cavity during the said relative movement.

The invention is based on the realisation that it is possible to dispense with an embodiment with a feeder mold body that can be slid telescopically over the supply element, and the object according to the invention can be achieved if a supply element is provided which has a deformation region capable of being inverted.

Such a deformation region designed according to the invention is preferably inverted along a predetermined section, preferably in the direction of the feeder cavity, wherein the upsetting forces that act on the feeder insert owing to the compaction of the mold material can advantageously be compensated or absorbed by means of a compensation movement of the deformation region. Thus, the risk of fracture or other damage to the feeder insert is reduced even in the case of incorrect handling.

The deformation region is preferably designed to invert in the direction of the interior of the mold body. As a result of a movement of the mold body in the feeder longitudinal direction relative to at least one part of the supply element, that is to say as a result of upsetting of the feeder insert according to the invention, it is achieved that at least one section of the deformation region of the supply element projects at least over a predetermined distance into a region, corresponding to the supply element, of the mold body for the liquid metal. Correspondingly, the invention also relates to a feeder insert for use for the casting of metals into casting molds, having a mold body and a supply element which delimit the feeder cavity for receiving liquid metal, wherein the supply element has a passage opening for the liquid metal, and wherein the mold body is movable in a feeder longitudinal direction relative to at least one part of the supply element, wherein the supply element has a deformation region which is configured to invert at least in sections in at least a first phase of a relative movement of the mold body in the feeder longitudinal direction and in the direction of the supply element, and possibly in the direction of the interior of the mold body, wherein, as a result of a movement of the mold body in the feeder longitudinal direction relative to at least one part of the supply element, it is achieved that at least one section of the deformation region of the supply element projects at least over a predetermined distance into a region, corresponding to the supply element, of the mold body for the liquid metal. The inverting of a section of the deformation body into the mold body results in an advantageously shortened form of the supply element and thus a reduced spacing between the mold body and the casting to be produced. The upsetting movement of the feeder insert is simultaneously associated with an upsetting of the supply element, wherein the deformation region of the supply element is designed or configured such that, after at least a first phase of the relative movement between the mold body and supply element, it has two wall sections running approximately parallel in the feeder longitudinal direction and thus also preferably in the direction of the feeder longitudinal axis.

The deformation region of the supply element is preferably designed to invert in the direction of the mold body (at least substantially) without a dead space; this means that, after the inverting process, no parts of the (inverted) supply element impede liquid metal from flowing out of the feeder cavity by forming a dead space within the cavity. Preferably, and with corresponding configuration of the feeder insert, it is thus ensured that liquid metal entering the feeder cavity is not retained in the feeder cavity during the solidification of the casting by parts or sections of the inverted (turned-in or turned-over) deformation region. Alternatively, it is in some cases advantageous for the sleeve-like deformation region of the supply element to be configured such that it has a cross section considerably smaller than the free cross section of the feeder cavity. Thus, the inverted material sections protrude project freely into the feeder cavity (that is to say the inverted material sections are not in contact with the inner wall of the feeder cavity).

A feeder insert according to the invention is preferable in which the inverted section of the deformation region is designed to bear against a wall region of the mold body. Thus, the invention also relates to a feeder insert for use for the casting of metals into casting molds, having a mold body and a supply element which delimit the feeder cavity for receiving liquid metal, wherein the supply element has a passage opening for the liquid metal, and wherein the mold body is movable in a feeder longitudinal direction relative to at least one part of the supply element, wherein the supply element has a deformation region which is configured to invert at least in sections in at least a first phase of a relative movement of the mold body in the feeder longitudinal direction and in the direction of the supply element, wherein the inverted section of the deformation region is designed to bear against a wall region of the mold body. A preferred feeder insert of this kind preferably comprises additional features which are referred to above or below as being preferred.

The deformation region of a supply element of a feeder insert according to the invention is preferably configured such that, after the inverting process, at least one wall part of the inverted section of the deformation region bears against a wall region of the mold body. It is achieved in this way that liquid metal rising into the feeder insert through the passage opening of the supply element cannot penetrate between the inner wall of the mold body and the wall part, supported thereon, of the inverted section. Thus, an additional sealing function is performed by the deformation region that inverts in the direction of the interior of the mold body. Furthermore, the support of that section of the supply element which is inverted into the feeder cavity of the mold body has the advantage that, during the relative movement of the mold body with respect to the supply element, guidance of the deformation region is realised which ensures a preferably concentric orientation of the mold body and supply element. Lateral or single-sided outward kinking of the supply element or oblique running of the supply element during the upsetting movement (that is to say the said relative movement) of the feeder insert according to the invention is accordingly prevented. The invention correspondingly also relates to a feeder insert for use for the casting of metals into casting molds, having a mold body and a supply element which delimit the feeder cavity for receiving liquid metal, wherein the supply element has a passage opening for the liquid metal, and wherein the mold body is movable in a feeder longitudinal direction relative to at least one part of the supply element, wherein the supply element has a deformation region which is configured to invert at least in sections in at least a first phase of a relative movement of the mold body in the feeder longitudinal direction and in the direction of the supply element, wherein the deformation region of the supply element is preferably configured such that, after the inverting process, at least one wall part of the inverted section of the deformation region bears against a wall region of the mold body.

In one refinement of the invention, the deformation region is designed such that, during a second phase, which follows the first phase, of the upsetting movement, that is to say of the relative movement between the mold body and supply element, said deformation region kinks inward, preferably over the full circumference, along a part. The kinking-inward of a part of the deformation region advantageously results in a limitation of the inverting-depth of the supply element within the mold body. The deformation region is preferably configured such that the kinking-inward of the part or the formation of the generated kink region takes place in a section of the deformation region which is closer to the passage opening of the supply element than the section inverted in the first phase of the relative movement. Here, with corresponding configuration of the deformation region and of the feeder mold body, the kinking-inward process has no influence on that section of the deformation region that has already been caused to bear against the inner wall of the mold body in the first phase of the relative movement between the mold body and supply element. After the relative movement has been completed, the inverted section and the kink region of the deformation region preferably form conical or a cylindrical shell surfaces adjoining one another. The initially linguistic division of the relative movement into a "first" and a "second" phase is not mean that the upsetting movement of the feeder insert is temporally interrupted in practice. Rather, in practice, the upsetting movement takes place at least approximately without temporal interruption. The division of the relative movement of mold body and supply element into two phases however describes plastic deformation processes that take place in succession in certain configurations of a feeder insert according to the invention. The kinking-inward of a part of the deformation region in a second (upsetting) phase is however optional: Depending on the configuration of mold body and supply element and depending on the compaction process and the associated upsetting of the feeder insert, kinking-inward of a part of the deformation region of the supply element will not imperatively take place. A preferred feeder insert of this kind preferably comprises additional features which are referred to above or below as being preferred.

The supply element is preferably connected to the mold body of a feeder insert according to the invention via a coupling region which ensures a stable connection between supply element and mold body during the inverting process. By means of the coupling region that is provided, a secure connection between the mold body and supply element is ensured, which connection advantageously prevents the supply element from deflecting during the relative movement, and thus prevents the inverting process of the deformation region into a section of the mold body from being inadvertently interrupted or misaligned.

The supply element preferably has a support region which engages on the mold body and which serves to form a coupling region between the supply element and mold body. The formation of a support region which is preferably in form-fitting contact with the mold body represents a structurally simple possibility for the formation of a coupling region between mold body and supply element. The support region, which engages on the mold body, of the supply element forms an abutment which counteracts a relative movement of the mold body and which, during the upsetting movement of the feeder insert according to the invention, is moved in the direction of, for example, a pattern plate of the casting mold. The support region is directly connected to the deformation region of the supply element, whereby an advantageously fixed and simultaneously secure connection between the two sections of the supply element is realised.

The feeder insert preferably has a feeder longitudinal axis, wherein the support region is a collar which is in contact with the underside of the mold body and which extends substantially radially with respect to the feeder longitudinal axis. A collar designed which is designed in this way and which bears against the underside of the mold body serves to ensure an optimum transmission of the pressure forces which originate from the relative movement and which are transmitted to the supply element for the shaping of the deformation region of the supply element. The collar that bears against the underside of the mold body preferably has a corresponding lateral projecting length of at least 4 mm (preferably at least 11 mm, particularly preferably at least 15 mm) and preferably has a material thickness in the range from 0.2 mm to 0.8 mm, and preferably of approximately 0.5 m. A preferred feeder insert of this kind preferably comprises additional features which are referred to above or below as being preferred.

The deformation region of the supply element of a feeder insert according to the invention preferably has a cylindrical sleeve, or is formed with a cylindrical sleeve, which (before the relative movement) has a bead-like depression, which projects outward in the manner of a bent flange, in the transition to the support region. By means of such an outwardly projecting bead-like depression on the top end of the cylindrical sleeve, the deformation region of the supply element designed according to the invention undergoes a desired shaping movement during the upsetting process, which shaping movement, during the inverting process, is positioned in for example a correspondingly stable subsection of the supply element itself or along a section of the mold body. The bead-like depression on the upper end of the deformation region of the supply element preferably has a width in the range from 3 to 5 mm, preferably of approximately 3 mm, and a depth in the range from 2 to 8 mm, preferably of approximately 4 mm. It is preferable for a rounded or curved transition with a radius of between 1 and 2 mm to be provided in the transition region between the cylindrical sleeve, which extends in the feeder longitudinal direction, of the deformation region and an annular section which extends radially on the upper end of the sleeve and which forms the base of the bead-like depression.

In one advantageous refinement of the invention, the supply element has an extension region which tapers conically below the deformation region, which has the advantage that the feeder insert according to the invention has a relatively small footprint or extension surface on a pattern plate of a casting mold. The supply element preferably tapers to less than half of the sleeve cross section of the deformation region, with the result that effective dense feeding can be implemented even in the case of relatively small castings. It is preferable for an angle in the range from 25° to 40°, preferably of approximately 32.5°, to be provided between the cylindrical sleeve and the conical extension region. The use of a conically tapering extension region furthermore has the advantage that the extension region exhibits optimum dimensional stability or stiffness with respect to the pressure loading arising from the compaction and the associated relative movement of the mold body. Furthermore, with the conical extension region, the height of the deformation region of the supply element is advantageously limited, whereby an adequate action of force on the extension region for sealing abutment against the casting mold is ensured at all times. A preferred feeder insert of this kind preferably comprises additional features which are referred to above or below as being preferred.

The extension region is preferably equipped with a breaking edge which is preferably part of a breaking core. By virtue of the supply element being equipped preferably with a metallic breaking core, a relatively sharp breaking edge is attained, resulting in a considerable reduction in the required reworking of the casting to be produced. Furthermore, the footprint or extension surface for the feeder insert according to the invention can be kept relatively small when a breaking edge is used.

In an alternative embodiment of the invention, the extension region of the supply element preferably has beads running in a direction of extent (from the extension surface to the cylindrical sleeve), such that the durability or stiffness with respect to the pressure forces acting on the extension region is advantageously increased. Thus, it is possible to minimise the risk of the extension region undergoing plastic deformation during the compaction process of the mold material for the casting mold. It is preferable for multiple beads to be distributed uniformly over the circumference of the conically tapering extension region. The extension region preferably has at least four beads which extend preferably over the entire length of said extension region (from the extension surface to the cylindrical sleeve). A preferred feeder insert of this kind preferably comprises additional features which are referred to above or below as being preferred.

In one preferred refinement of the invention, it is provided that the mold body and/or the supply element have guide surfaces for guiding a centering core; it is preferable for the feeder insert according to the invention to be configured as a self-centering feeder insert. The use of a centering core, also referred to as a centering pin, is advantageous whenever a targeted orientation of the feeder insert with respect to the pattern plate of a casting mold is necessary. The use of a centering core and the configuration of the feeder insert as a self-centering feeder insert advantageously simplifies the handling thereof. A feeder insert according to the invention and of self-centering configuration preferably has, in its tapering extension region, guide surfaces running parallel to the feeder longitudinal axis, and the mold body, in an upper, horizontally running wall part, has a centering recess, arranged coaxially with respect to the feeder longitudinal axis, for an upper end section of the centering core, preferably of a centering tip.

One advantageous embodiment of the feeder insert according to the invention provides that the material for the supply element is formed from or comprises a metallic material. The use of a preferably metallic material for the material used for forming the supply element has proven beneficial owing to the advantageous properties with regard to temperature resistance in respect of the liquid metal that rises via said supply element and with regard to the deformation capability of the deformation region in respect of the inverting process to be implemented therewith. The supply element is designed such that the plastic deformation can be realised by way of the deformation region without material sections of the deformation region being structurally weakened. Material fracture is thus advantageously prevented. A cold-rolled forming steel is preferably used as an advantageous option for the formation of the supply element.

It is preferable for the material for the mold body to be or to comprise a material which has exothermic and/or insulating properties. With the material that is used that has both exothermic and also insulating properties, it is achieved in an advantageous manner that the liquid metal that rises into the feeder cavity is kept in the liquid state over an adequately long period of time. The configuration of the outer and inner contours of the mold body and of the wall thickness thereof is preferably coordinated with or adapted to the size of the casting and thus the casting volume thereof and the resulting hold-back time for the metal to be kept in the liquid state. The mold body preferably automatically ignites after the liquid metal flows into the feeder cavity.

A further aspect of the invention relates to a casting mold, for which protection is claimed independently, having a feeder insert which is designed according to the invention according to at least one of claims 1 to 15. Equipping a casting mold with at least one such feeder insert designed according to the invention permits a simple compaction of the mold material, which also encases inter alia the feeder insert. The feeder insert according to the invention ensures an advantageous upsetting movement during the compaction of the mold material, such that even relatively high compaction pressures can be generated without problems on the casting mold. Furthermore, with the deformation region on the supply element according to the invention, the risk of penetration of mold material and/or abraded material into the casting mold is advantageously reduced. This likewise has an advantageous effect on the reliability and the productivity of the production process.

Another aspect of the invention relates to a method for arranging a feeder insert in a casting mold, having the following steps: providing a feeder insert according to one of claims 1 to 15, arranging the feeder insert in a molding machine such that the mold body and the supply element are present in an arrangement proceeding from which the mold body can be moved relative to at least one part of the supply element, filling mold material into the molding machine such that the outer wall of the feeder insert is placed in contact with the mold material, and compressing the molding sand such that the mold body is displaced relative to the supply element, and at least one section of the deformation region of the supply element is inverted. The molding machine used in conjunction with the method according to the invention preferably comprises a pattern plate (that is to say a pattern device for molding machines, generally composed of a flat plate with patterns cast therein or mechanically fastened thereto). The supply element is preferably arranged so as to be in direct contact with the surface of the pattern plate before the compaction process of the mold material. Direct contact with the pattern plate is advantageous specifically when a breaking edge, which is preferably part of a breaking core, is integrated into the supply element. Alternatively, the feeder insert is used together with a centering core or centering pin, by means of which the orientation of the feeder insert with respect to the pattern plate is simplified but the supply element remains in direct contact with the surface of the pattern plate.

A further alternative embodiment of the invention provides the use of a centering core which is designed such that only the centering core is preferably in direct contact with the pattern plate after the insertion of the feeder insert into the molding machine. The feeder insert itself is then in direct contact with the centering core. Here, the centering core (centering pin) preferably includes a centering ring by means of which the extension region of the supply element is held spaced apart from the surface of the model plate, such that a gap is produced between the extension region of the feeder insert and the model plate. The gap dimension is preferably less than 1 mm, preferably less than 0.5 mm, particularly preferably less than 0.3 mm.

A preferred refinement of the method according to the invention is characterized in that a section of the deformation region of the supply element is inverted in the direction of the interior of the mold body (that is to say in the direction of the feeder cavity) when the mold body is moved in the feeder longitudinal direction toward the supply element, preferably pushed over the supply element. The inverting of the deformation region into at least one section of the feeder cavity has the advantage that the mold body is moved virtually completely over the supply element. In this way, depending on the amount of mold material filled in below the mold body, it is possible for the mold body to be placed in direct contact, if appropriate, with the pattern plate of the casting mold.

With regard to further preferred embodiments of the method according to the invention, reference is made to the above explanations regarding the preferred embodiments of the described feeder insert.

A preferred supply element according to the invention is of unipartite form and comprises a tubular body which defines a passage region for the liquid metal. The supply element has a first and a second end region which are spaced apart from one another, wherein the first end region of the supply element is mounted by way of its mounting region onto a mold plate, also referred to as mold pattern. The second end region, which faces toward the mold body, widens in an outward direction in relation to the first end region of the supply element.

If a support region, which is preferably in the form of a collar, is provided on the supply element, the support region supports the mold body during use, wherein, in one embodiment, the support region, which is preferably in the form of an encircling collar, runs perpendicular to the feeder longitudinal axis of the feeder insert. A further embodiment provides that the support region in the form of a collar is inclined relative to the feeder longitudinal axis such that the angle between the collar and the feeder longitudinal axis is not equal to 90°. This refinement of the invention may be combined in each case with other sub-aspects of the present invention; with regard to preferred combinations, that which has been stated in the corresponding passages of text applies correspondingly in each case.

A bead-like depression arranged on the second end region of a preferred supply element is preferably formed by virtue of the tubular body initially being flared in a radially outward direction and then bent over in the direction of the first end region again. The bead-like depression preferably has a U-shaped form, whereby two wall sections running approximately parallel to one another are formed on the bead-like depression. In this way, during the relative movement of the supply element and mold body with respect one another, a uniform (virtually symmetrical), smooth upsetting of the supply element is effected. By means of the wall sections, which preferably run parallel to one another, the bead-like depression has an inner diameter and an outer diameter. The distance between the wall regions running parallel to one another determines the width dimension of the bead-like depression, which in relation to the maximum diameter of the supply element preferably has a width of at least 3 to 10% of the maximum diameter of the supply element. It is however preferably the case that, in comparison with the maximum diameter of the supply element, the width of the bead-like depression preferably amounts to less than 20, 15 or 10% of the maximum diameter of the supply element.

The height of a bead-like depression arranged on a preferred supply element (as measured in the direction of the feeder longitudinal axis) has a height in the range between 3 and 20% of the overall height of the supply element, in particular before the compression of the supply element. During the compaction of the mold material, the supply element is upset, with the result that the overall height of the supply element is reduced, and the height of the bead-like depression in the deformation region of the supply element considerably increases in at least a first phase of the relative movement between mold body and supply element. The height of the bead-like depression is preferably in a ratio in the range between 0.5 and 0.9 in relation to the overall height of the supply element after a first phase of the upsetting of the supply element.

To achieve upsetting of a supply element, which is preferably to be used, during the process of compaction of the mold material, and thus to achieve the desired ratio between the height of the bead-like depression and the overall height of the supply element after the upsetting process, a force in the range from at least 2 to 4.5 kN is preferably exerted on the support region of the supply element.

A preferred supply element according to the invention preferably has a material thickness on its tubular body of between 0.1 and 1.5 mm, preferably between 0.3 and 0.9 mm, and particular preferably between 0.4 and 0.6 mm. This refinement of the invention may be combined in each case with other sub-aspects of the present invention; with regard to preferred combinations, that which has been stated in the corresponding passages of text applies correspondingly in each case.

In order to prevent fracture of a preferred mold body according to the invention or damage to the supply element during the compaction of the mold material, it is provided that the initial upsetting resistance of a preferred supply element amounts to at most 7000 N, 5000 N or 3000 N. The initial upsetting resistance of the supply element should however be at least in a range between 250 N and 1000 N in order to prevent inadvertent compression of the supply element during the handling thereof for mounting on the mold body or during storage and transport. The inverting resistance of the deformation region on a preferred supply element according to the invention, which counteracts the force required to forcibly and completely invert the deformation region, after the initial upsetting resistance of the supply element has been overcome, preferably lies in a range between at most 4000 N and 9000 N. In this way, undesired fracture on a mold body is prevented. The inverting resistance of the deformation region amounts to at least 750 N. A preferred feeder insert of this kind preferably comprises additional features which are referred to above or below as being preferred.

A supply element which is preferably used is composed of a multiplicity of suitable materials, such as for example metallic material such as steel, aluminum, aluminum alloys, brass, copper or the like, or of non-metallic materials such as, for example, plastic. The initial upsetting resistance and the inverting resistance of the supply element used in each case are then derived in particular from the material used.

A mold body used in conjunction with a supply element to be used according to the invention preferably has, in a manner dependent on the initial upsetting resistance and the inverting resistance of the supply element, an upsetting resistance of at least 5 kN, 8 kN, 12 kN, 15 kN, 20 kN or 25 kN. In a series of embodiments of the mold body, the upsetting resistance thereof is preferably less than 25 kN, 20 kN, 18 kN, 15 kN, 10 kN or 8 kN. In this case, the strength of the mold body is dependent in particular on the composition of the constituent parts used to produce the mold body, on the binding agents that hold the constituent parts together, and on the production method used to produce the mold bodies. Furthermore, the size and shape of the mold body preferably also have an influence on the upsetting resistance thereof. The above-described embodiments of supply element and mold body may each be combined with the other sub-aspects of the present invention. With regard to preferred combinations, that which has been stated in the relevant passages of text applies correspondingly in each case.

In one embodiment, the tubular body of a preferred supply element, wherein one section of the tubular body is in the form of a deformation region, has a circular cross section. The cross section of the tubular body is not imperatively circular, but could also be for example oval, rounded or elliptical. In a preferred embodiment, the tubular body narrows (tapers) toward the first end region. A narrow section adjacent to the casting is known as "feeder neck" and permits better "knocking-off" of the feeder after the casting process. In a series of embodiments, the angle of the tapering neck relative to the feeder longitudinal axis should be less than 45°.

The invention will be explained in more detail below on the basis of possible exemplary embodiments and with reference to the appended figures, in which.

Figure 1:
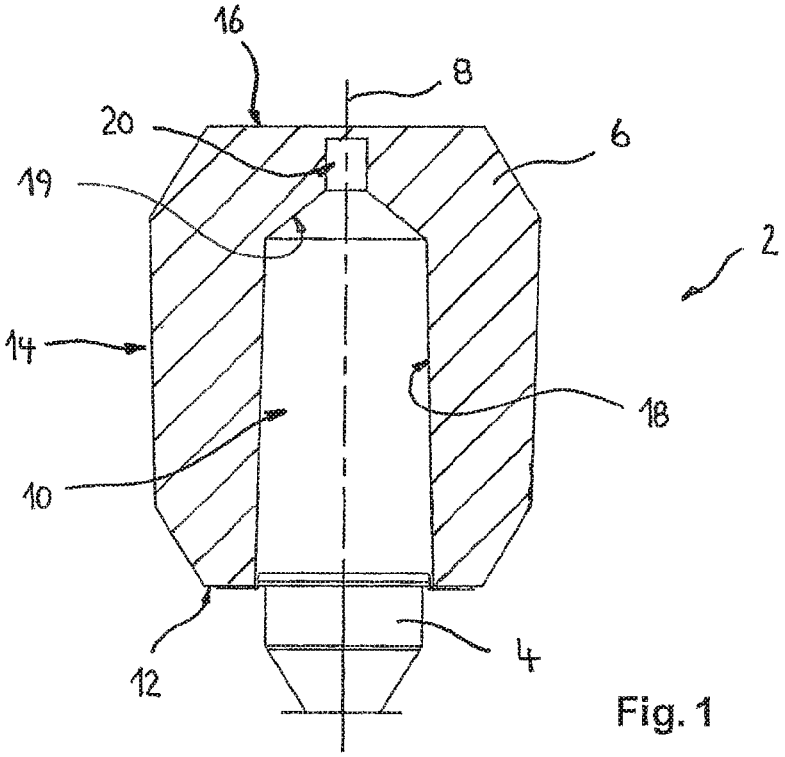
FIG. 1 is a schematic illustration of a feeder insert according to the invention in its initial arrangement, in longitudinal section.

FIG. 1 shows a feeder insert 2 according to the invention in its initial arrangement. The feeder insert 2 has a supply element 4 and a mold body 6. The supply element and the mold body 6 are preferably formed as substantially rotationally symmetrical mold parts. The axis of rotation of the feeder insert 2 (feeder longitudinal axis), which runs in the feeder longitudinal direction, is indicated by a dash-dotted line 8. The mold body 6 has an outer contour which, in a lower section proceeding from the underside 12 of the mold body 6, widens conically in an upward direction. In a central part 14 which extends over more than half of the overall height of the mold body 6, the mold body 6 has an outer contour which continues to widen conically to a small degree. In an upper section of the mold body, the mold body tapers again conically and ends at a horizontally running top side 16. The inner contour, which defines the feeder cavity, of the mold body 6 has an inner wall 18 which tapers conically to a small degree in an upward direction proceeding from the underside 12, which inner wall, in the upper section of the mold body 6, merges into a wall part 19 which narrows in a more intensely funnel-shaped manner and which constitutes a guide surface for a centering core or centering pin (not illustrated in the drawing of FIG. 1), The upper termination of the feeder cavity 10 is formed by a cylindrical centering recess 2 receiving the tip of the centering core centering pin.

Figure 2:
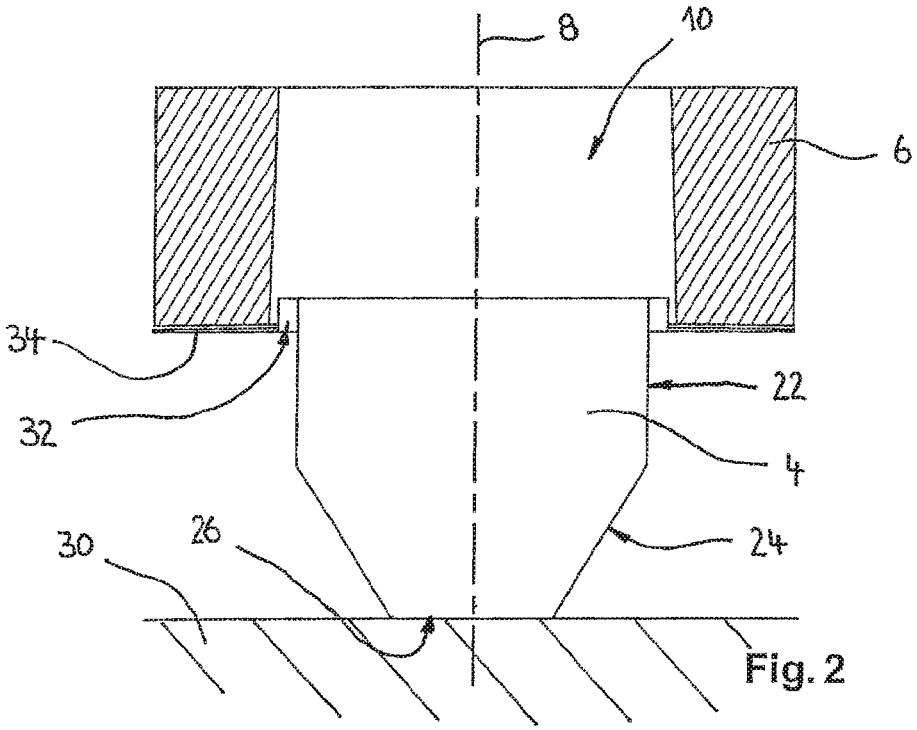
FIG. 2 shows a detail view of a supply element according to the invention as per FIG. 1, in longitudinal section.

FIG. 2 shows a detail view of the supply element 4 which has a cylindrical, sleeve-like deformation region 22 and an extension region 24 which, on the deformation region, tapers in the direction of an indicated pattern plate 30. The extension region has a passage opening 26. At the upper end of the deformation region there is provided an encircling bead-like depression 32, on which there is laterally arranged a support region 34 running in a radial direction with respect to the feeder longitudinal axis 8 and which is by way of example in the form of a collar which is in contact with the underside 12 of the mold body 6.

Figure 3:
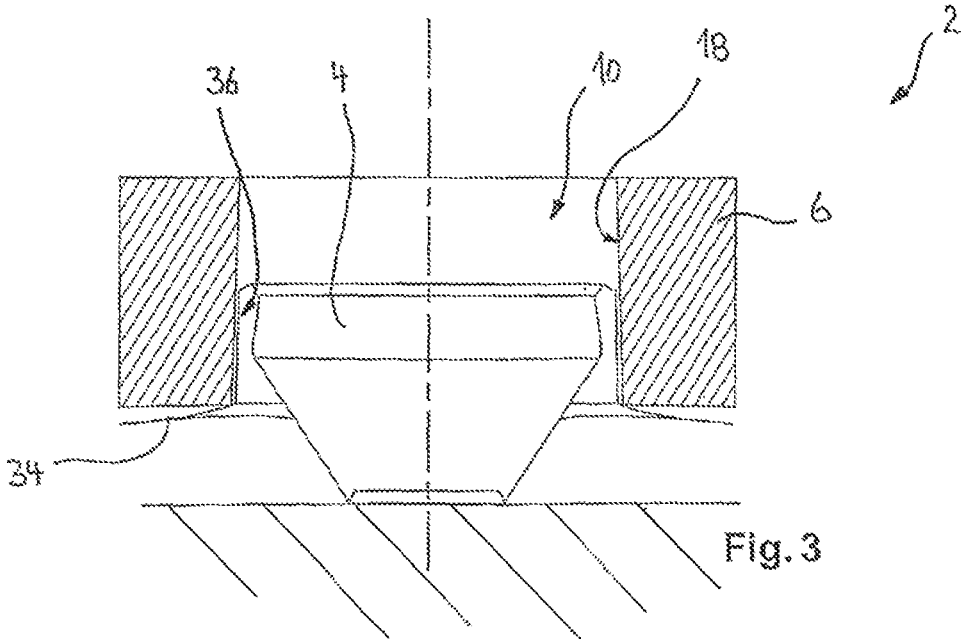
FIG. 3 shows a detail view of the supply element according to the invention, showing the supply element in a partially inverted state in the mold body.

FIG. 3 shows the feeder insert 2 according to the invention during a first phase of a relative movement between the supply element 4 and mold body 6. Owing to a prior displacement of the mold body 6, it is already the case in the illustration as per FIG. 3 that the upper region of the deformation region has been inverted, in sections, in the direction of the feeder cavity 10. The inverted section (inverted section) 36 bears against the inner wall 18 of the mold body 6. FIG. 3 shows that the support part 34 warps in regions owing to the forces acting on it, said forces being caused by the movement of the mold body 6; material fracture is prevented in this way.

Figure 4:
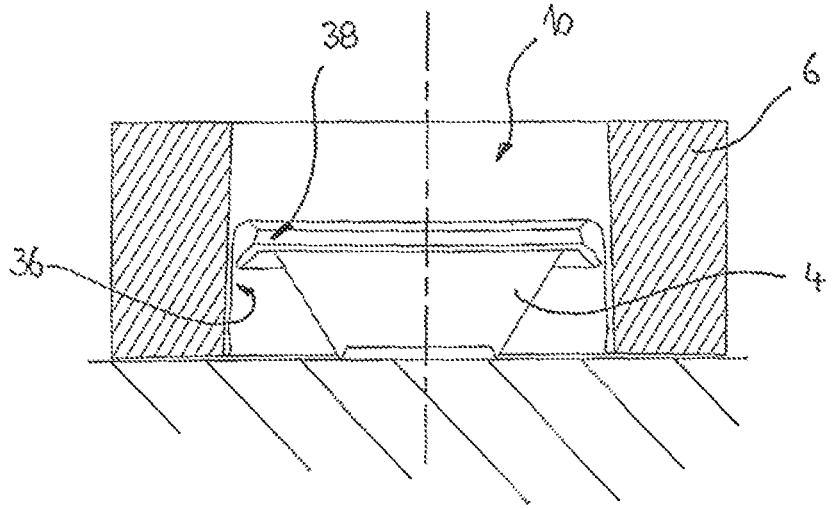
FIG. 4 shows a detail view of the supply element after a completed relative movement between the mold body and supply element.

FIG. 4 shows the supply element designed according to the invention after a completed upsetting movement, that is to say a maximum relative movement between the mold body 6 and supply element 4. In addition to the inverted section 36 of the deformation region 22, a kink region 38 has also formed. In an alternative embodiment of the invention not illustrated in a drawing, which embodiment dispenses with a kink region, it is the case after a completed upsetting movement that the supply element has merely an inverted section which (depending on the dimensions of the supply element and the dimensions of the cavity in the mold body) bears directly against the inner wall of the mold body 6 or extends into the feeder cavity 10 with a spacing to the inner wall (that is to say without making direct contact with the inner wall).

Figure 5:
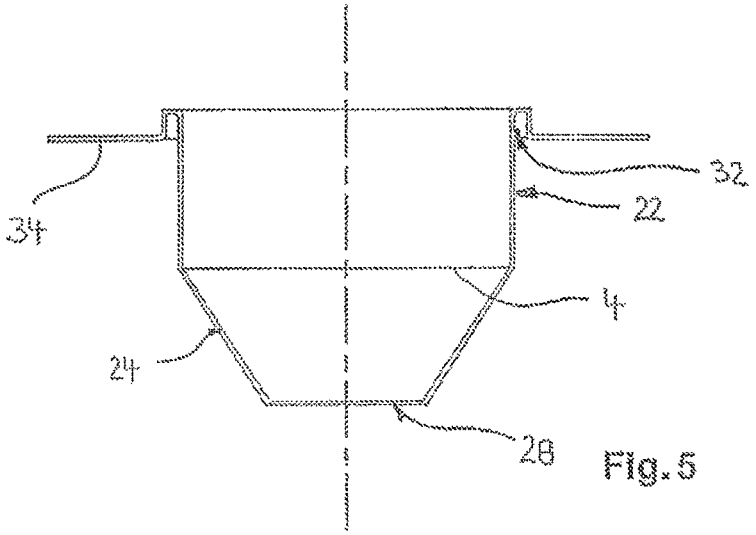
FIG. 5 shows a detail view of the supply element according to the invention.

FIG. 5 shows the supply element in a detail view and illustrates more clearly the structural design thereof. The supply element 4 is rotationally symmetrical and is preferably formed in one piece from a metallic material, for example from a soft steel which is suitable for cold working. Here, the supply element forms a lower part of the feeder insert 2 according to the invention, which lower part, after its shaping which is performed preferably by means of deep drawing, has a material thickness of approximately 0.5 mm. The supply element 4 is formed from the conically running extension region 24, the cylindrical deformation region 22, the bead-like depression 32 and the support region 34. The bead-like depression 32 which connects the deformation region 22 to the support region 34 forms the region at which the inverting process starts while the upsetting movement of the feeder insert 2 according to the invention is taking place.

Figure 6:
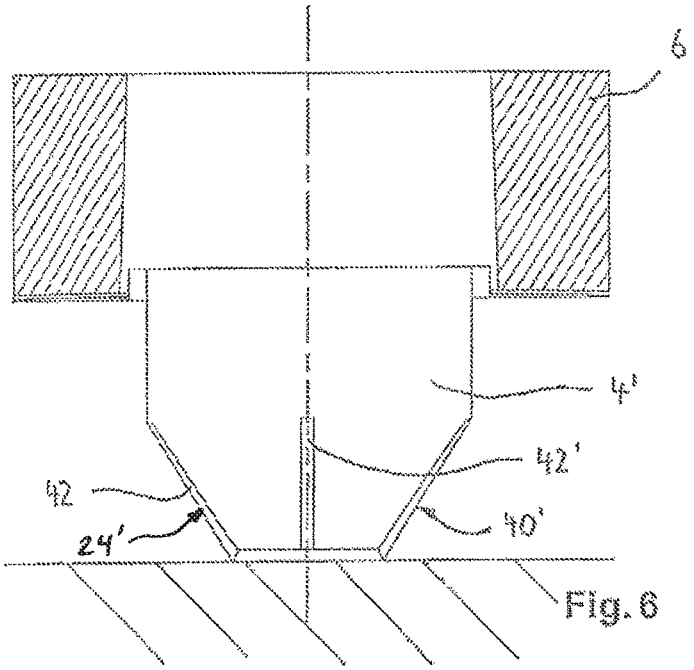
FIG. 6 shows a detail view of a feeder insert with a supply element of alternative design.

FIG. 6 shows a supply element 4' of alternative design which, by contrast to the exemplary embodiment shown in FIG. 2, has multiple beads 42, 42' on its conically running or funnel-shaped extension surface 40' and in the direction of extent of the extension region 24'. The beads 42, 42' have the effect of increasing the strength or deformation resistance of the extension region 24' of the supply element 4'.

After the placement of the feeder insert 2 according to the invention onto the pattern plate 30 (FIG. 2), the filling (not shown in any more detail) of mold material into a mold box that receives the pattern plate firstly takes place, such that the supply element and the mold body of the feeder insert 2 are at least laterally encased by the mold material. The mold material is then compacted, and the compaction effects an upsetting movement of the feeder insert (that is to say a relative movement between the supply element 4 and the mold body 6). Owing to the upsetting movement, the deformation region 22 of the supply element 4 is inverted at least in sections into the feeder cavity 10 (FIG. 3). Here, the inverted section 36 which is formed bears against the inner wall 18 of the mold body 6. After a completed upsetting movement, as shown in FIG. 4, the underside 12 of the mold body 6 bears directly against the pattern plate 30. In addition to the inverted section 36, a kink region 38 is generated, whereby the inverted depth of the supply element 4 into the feeder cavity 10 is kept small.

Figure 7:
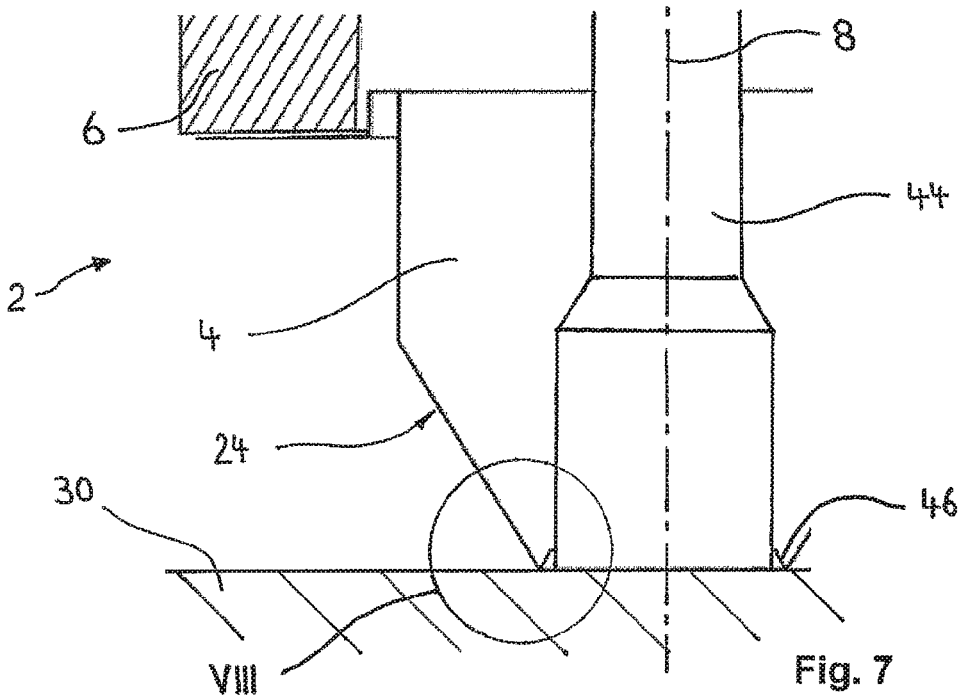
FIG. 7 shows a schematic partial view of the feeder insert according to the invention from FIG. 1 in combination with an alternative centering pin.
Figure 8:
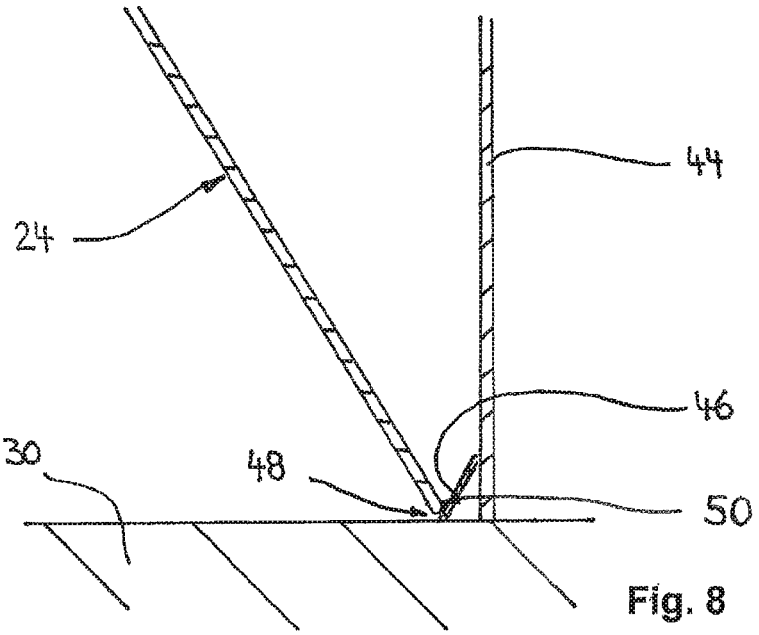
FIG. 8 shows an enlarged view of the detail VIII circled in FIG. 7.

FIG. 7 shows a partial view of the feeder insert 2 according to the invention which is arranged and oriented on the pattern plate 30 by means of a specifically configured centering core (centering pin) 44. The centering core 44 includes a centering ring 46 (in contact with the pattern plate 30) which, in the direction of the pattern plate 30, widens conically in relation to the feeder longitudinal axis 8. As shown in FIG. 8, the centering ring 46 forms a base for the extension region 24, which is to be pushed thereon, of the supply element 4. Owing to the conical shape of the centering ring 46, automatic centering of the feeder insert 2 relative to the centering core 44 is also realized. In the present case, the centering ring 46 is adapted in terms of its dimensions to the dimensions of the extension region 24, preferably of the passage opening 26 thereof (FIG. 2), such that the extension region 24 of the supply element 4 is seated on the conical centering ring 46 and is thereby held spaced apart from the surface of the pattern plate 30. In this way, a gap 48 is generated between the extension region 24 of the feeder insert and the pattern place 30, cf. again FIG. 8. The gap dimension is preferably less than 0.3 mm. In the appended figures, identical components are denoted by the same reference signs.

In an alternative exemplary embodiment of the invention which is not shown, the feeder insert according to the invention is used together with a centering core which does not have or comprise a centering ring. In this case, the extension region of the supply element of the feeder insert, after the latter is inserted into the molding machine, comes into direct contact with the surface of the pattern plate despite the use of a centering core.

The invention claimed is:

1. A feeder insert for use for the casting of metals into casting molds, having a mold body (6) and a supply element (4) which delimit the feeder cavity (10) for receiving liquid metal, wherein the supply element (4) has a passage opening (26) for the liquid metal, and wherein the mold body (6) is movable in a feeder longitudinal direction relative to at least one part of the supply element (4), wherein the supply element (4) has a deformation region (22) which is designed to invert at least in sections in at least a first phase of a relative movement of the mold body (6) in the feeder longitudinal direction and in the direction of the supply element (4), wherein a wall part of an inverted section (36) of the deformation region (22) is configured so as to be supported against an inner wall of the mold body (6).

2. The feeder insert as claimed in claim 1, wherein the deformation region (22) is designed to invert in the direction of the interior of the mold body (6).

3. The feeder insert as claimed in claim 1, wherein as a result of a movement of the mold body (6) in the feeder longitudinal direction relative to at least one part of the supply element (4), it is achieved that at least one section (36) of the deformation region (22) of the supply element (4) projects at least over a predetermined distance into a region, corresponding to the supply element, of the mold body (6) for the liquid metal.

4. The feeder insert as claimed claim 1, wherein the deformation region (22) of the supply element (4) is designed or configured such that, after at least a first phase of the relative movement between the mold body (6) and supply element (4), it has two wall sections running approximately parallel in the feeder longitudinal direction.

5. The feeder insert as claimed in claim 1, wherein the deformation region (22) is designed to invert in the direction of the mold body (6) without a dead space.

6. The feeder insert as claimed in claim 1, wherein the deformation region (22) is designed such that, during a second phase, which follows the first phase, of the relative movement between the mold body (6) and supply element (4), said deformation region kinks inward along a part.

7. The feeder insert as claimed claim 1, wherein the supply element (4) is connected to the mold body (6) via a coupling region which ensures a connection between supply element (4) and mold body (6) during the inverting process.

8. The feeder insert as claimed in claim 1, wherein the supply element (4) has a support region (34) which engages on the mold body (6) and which serves to form a coupling region between the supply element (4) and mold body (6).

9. The feeder insert as claimed in claim 1, wherein the feeder insert (2) has a feeder longitudinal axis (8), wherein the support region (34) is a collar which is in contact with the underside (12) of the mold body (6) and which extends substantially radially with respect to the feeder longitudinal axis (6).

10. The feeder insert as claimed in claim 1, wherein the deformation region (22) has a cylindrical sleeve which, before the relative movement, has a depression (32), which projects outward in the manner of a bent flange, in the transition to the support region (34).

11. The feeder insert as claimed in claim 1, wherein the supply element (4) has an extension region (24) which tapers conically below the deformation region (22).

12. The feeder insert as claimed in claim 1, wherein the extension region (24) is equipped with a breaking edge (50).

13. The feeder insert as claimed in claim 1, wherein the extension region (24') of the supply element (4') has beads (42, 42').

14. The feeder insert as claimed in claim 1, wherein the mold body (6) and/or the supply element (4) have guide surfaces for guiding a centering core (44).

15. The feeder insert as claimed in claim 1, wherein the material for the supply element (4) is formed from or comprises a metallic material.

16. The feeder insert as claimed in claim 1, wherein the material for the mold body (6) is or comprises a material which has exothermic and/or insulating properties.

17. A casting mold having a feeder insert (2) as claimed in claim 1.

18. A method for arranging a feeder insert (2) in a casting mold, having the following steps:

providing a feeder insert (2) as claimed in claim 1, arranging the feeder insert (2) in a molding machine such that the mold body (6) and the supply element (4) are present in an arrangement proceeding from which the mold body (6) can be moved relative to at least one part of the supply element (4), filling molding material into the molding machines such that the outer wall of the feeder insert (2) is placed in contact with the molding material, compressing the molding sand such that the mold body (6) is displaced relative to the supply element (4), and at least one portion of the deformation region (22) of the supply element (4) is inverted, wherein a portion of the deformation region (22) is inverted into at least one portion of the feeder cavity of the mold body (6) when the mold body (6) is moved along the feeder longitudinal axis in the direction of the supply element (4).

19. The method as claimed in claim 18, wherein the molding machine has a pattern plate (30) and the supply element (4) is inserted into the molding machine such that it is placed in direct contact with the pattern plate (30) and/or with a centering core (44).

20. A feeder insert for use for the casting of metals into casting molds, having a mold body (6) and a supply element (4) which delimit the feeder cavity (10) for receiving liquid metal, wherein the supply element (4) has a passage opening (26) for the liquid metal, and wherein the mold body (6) is movable in a feeder longitudinal direction relative to at least one part of the supply element (4), wherein the supply element (4) has a deformation region (22) which is designed to invert at least in sections in at least a first phase of a relative movement of the mold body (6) in the feeder longitudinal direction and in the direction of the supply element (4), wherein the deformation region is designed so that at least a portion of the deformation region (22) is inverted into at least one portion of the feeder cavity of the mold body (6) when the mold body (6) is moved along the feeder longitudinal axis in the direction of the supply element (4).

* * * * *